US006866025B1

(12) United States Patent
Maass

(10) Patent No.: US 6,866,025 B1
(45) Date of Patent: Mar. 15, 2005

(54) HIGH PRESSURE FUEL PUMP DELIVERY CONTROL BY PISTON DEACTIVATION

(75) Inventor: Martin Maass, Williamsburg, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 0 days.

(21) Appl. No.: 09/442,977

(22) Filed: Nov. 18, 1999

(51) Int. Cl.[7] ..... F02M 37/04

(52) U.S. Cl. ..... 123/450; 123/179.17; 123/446; 417/269

(58) Field of Search ..... 123/456, 446, 123/198 F, 497, 450, 179.17; 417/269, 270, 273, 307, 299

(56) References Cited

U.S. PATENT DOCUMENTS

| | | | | | |
|---|---|---|---|---|---|
| 4,071,010 | A | * | 1/1978 | Miller | 123/198 F |
| 4,083,345 | A | * | 4/1978 | Davis | 123/450 |
| 4,530,324 | A | * | 7/1985 | Tanaka et al. | 123/300 |
| 5,109,822 | A | | 5/1992 | Martin | 123/456 |
| 5,201,294 | A | * | 4/1993 | Osuka | 123/458 |
| 5,311,850 | A | * | 5/1994 | Martin | 123/456 |
| 5,404,855 | A | | 4/1995 | Yen et al. | 123/446 |
| 5,571,243 | A | | 11/1996 | Arnold et al. | 123/198 |
| 5,626,114 | A | | 5/1997 | Kushida et al. | 123/198 |
| 5,700,136 | A | | 12/1997 | Sturman | 417/270 |
| 5,738,063 | A | * | 4/1998 | Pfuhl et al. | 123/198 D |
| 5,839,412 | A | * | 11/1998 | Stockner et al. | 123/446 |
| 5,878,718 | A | * | 3/1999 | Rembold et al. | 123/456 |
| 5,884,606 | A | * | 3/1999 | Kellner et al. | 123/446 |
| 6,095,118 | A | * | 8/2000 | Klinger et al. | 123/446 |

FOREIGN PATENT DOCUMENTS

DE 44 01 083 7/1995

* cited by examiner

*Primary Examiner*—Carl S. Miller

(57) ABSTRACT

A high pressure piston pump includes a housing having a low pressure fuel inlet and a high pressure fuel outlet; at least two pistons disposed in the housing; a driveshaft for supplying power to drive the at least two pistons; and a bypass valve fluidly connected to at least one of the at least two pistons to deactivate the at least one piston. A method of varying the flow output of a high pressure piston pump having at least two pistons includes deactivating at least one of the two pistons by directing fluid displaced by the at least one piston to a bypass valve.

35 Claims, 4 Drawing Sheets

HIGH PRESSURE FUEL PUMP DELIVERY CONTROL BY PISTON DEACTIVATION

BACKGROUND OF THE INVENTION

The present invention relates in general to high pressure direct injection systems for internal combustion engines and in particular to high pressure piston pumps used in such systems.

In high pressure direct injection systems (gasoline or diesel), high pressure (HP) pumps with fixed fluid displacement are typically used. The fluid delivered by the pump is dependent only on the engine rpm and not on the amount of fuel injected into the combustion chambers. The HP pumps are usually oversized so that under all circumstances there is enough fuel flow. Therefore, under light engine load conditions, the pump delivers too much fuel, because only a small amount of the delivered fuel is injected. Similarly, under light engine load conditions, the engine power used to drive the pump is unnecessarily large, resulting in a loss of fuel efficiency.

For future automotive applications, reduced power consumption of the BP pump will be of higher importance. This is particularly so when considering that the power consumption of the HP pump of the future may be two to four times higher than the present power consumption. For example, the fuel rail pressure may be doubled to 250 bar or the HP pump size may be increased for high displacement engine applications (V6 or V8 engines). These applications may need four times more fuel flow than at present.

Variable flow control HP pumps are necessary to reduce parasitic losses attributable to the HP pump and thereby increase engine efficiency. Also, a variable flow HP pump can deliver fast and safe engine starts, that is, fast fuel rail pressurization, without the parasitic pump losses after engine start. Additional advantages of variable flow HP pumps include less fuel heatup, downsizing of related components and possible elimination of some components, for example, the HP fuel regulator.

The advantages of variable HP pump flow are even more apparent when one realizes that the HP pump displacement is determined only by cold engine start requirements. Therefore, after cold engine starts using a high pressure start strategy, the HP pump fuel delivery is typically three times greater than needed for full load engine conditions. Even in the case of high pressure direct injection engines with a low pressure start strategy, a variable pump flow is desirable because the engine runs only a small part of its operation time at wide open throttle (WOT). That is, the high fuel flow delivery from the HP pump is needed only a few times during engine operation.

One proposal for a variable flow pump is a pump with infinitely variable delivery control. However, such a pump is very complicated. An alleged advantage of the infinitely variable delivery control pump is the elimination of the regulator valve. However, from a safety standpoint, if the regulator valve is eliminated, one would need a second safety valve for redundancy. Therefore, elimination of the regulator would not actually be a cost saving. In the present invention, the engine electronic control unit simply provides an on/off signal to a deactivation solenoid.

SUMMARY OF THE INVENTION

It is an object of the present invention to provide a high pressure piston pump with variable flow output.

It is another object of the present invention to provide a high pressure piston pump that reduces parasitic power losses on the engine.

It is a further object of the invention to provide a variable flow piston pump of the radial type.

It is yet another object of the invention to provide a variable flow piston pump of the axial type.

These and other objects of the invention are achieved by a high pressure piston pump comprising a housing having a low pressure fuel inlet and a high pressure fuel outlet; at least two pistons disposed in the housing; a driveshaft for supplying power to drive the at least two pistons; and a bypass valve fluidly connected to at least one of the at least two pistons to deactivate the at least one piston.

The bypass valve includes a solenoid for opening and closing the bypass valve. The bypass valve is normally open such that the at least one piston is normally deactivated. Preferably, the high pressure piston pump comprises three pistons wherein the bypass valve is fluidly connected to only one of the three pistons.

In a preferred embodiment, the piston to which the bypass valve is connected has a surface area that is larger than a surface area of each of the other two pistons. Most preferably, a surface area of the piston to which the bypass valve is connected is approximately twice the surface area of each of the other two pistons.

One aspect of the invention is a high pressure radial type piston pump comprising a housing having a low pressure fuel inlet and a high pressure fuel outlet; three pistons disposed in the housing; a driveshaft for supplying power to drive the three pistons; and a bypass valve fluidly connected to one of the three pistons to deactivate the one piston.

Another aspect of the invention is a high pressure axial type piston pump comprising a housing having a low pressure fuel inlet and a high pressure fuel outlet; three pistons a disposed in the housing; a driveshaft for supplying power to drive the three pistons; and a bypass valve fluidly connected to one of the three pistons to deactivate the one piston.

Yet another aspect of the invention is a method of varying the flow output of a high pressure piston pump having at least two pistons comprising deactivating at least one of the at least two pistons. The at least one piston is deactivated by directing fluid displaced by the at least one piston to a bypass valve.

Preferably, the bypass valve is normally open and directs the fluid to a low pressure area of the pump.

In one embodiment, the fluid displaced by the at least one piston is fuel for an engine.

In another embodiment, the fluid displaced by the at least one piston is hydraulic oil.

The method of the invention may further comprise closing the bypass valve to

Still another aspect of the invention is a high pressure fuel injection system comprising a source of fuel; a low pressure pump; a high pressure piston pump, the low pressure pump being disposed between the fuel source and the high pressure piston pump; a fuel rail including a plurality of fuel injectors, the high pressure piston pump being disposed between the low pressure pump and the fuel rail; and a fuel return line connecting the fuel rail to a low pressure side of the high pressure pump; wherein the high pressure piston pump comprises a housing having a low pressure fuel inlet connected to an output of the low pressure pump, a high pressure fuel outlet connected to an input to the fuel rail, at least two pistons disposed in the housing, and a bypass valve fluidly connected to at least one of the at least two pistons to deactivate the at least one piston.

Further objects, features and advantages of the invention will become apparent from the following detailed description taken in conjunction with the following drawing.

DETAILED DESCRIPTON OF THE PREFERRED EMBODIMENTS

The embodiments of the present invention include radial and axial HP piston pumps. A bypass valve in the pump allows selective deactivation of one or more pistons. By deactivating a piston, the amount of pump fuel output is reduced in a stepwise manner. Consequently, the pump's power consumption is reduced. Piston deactivation may be used when less fuel flow is needed, for example, at engine idle or part load.

Figure 1:
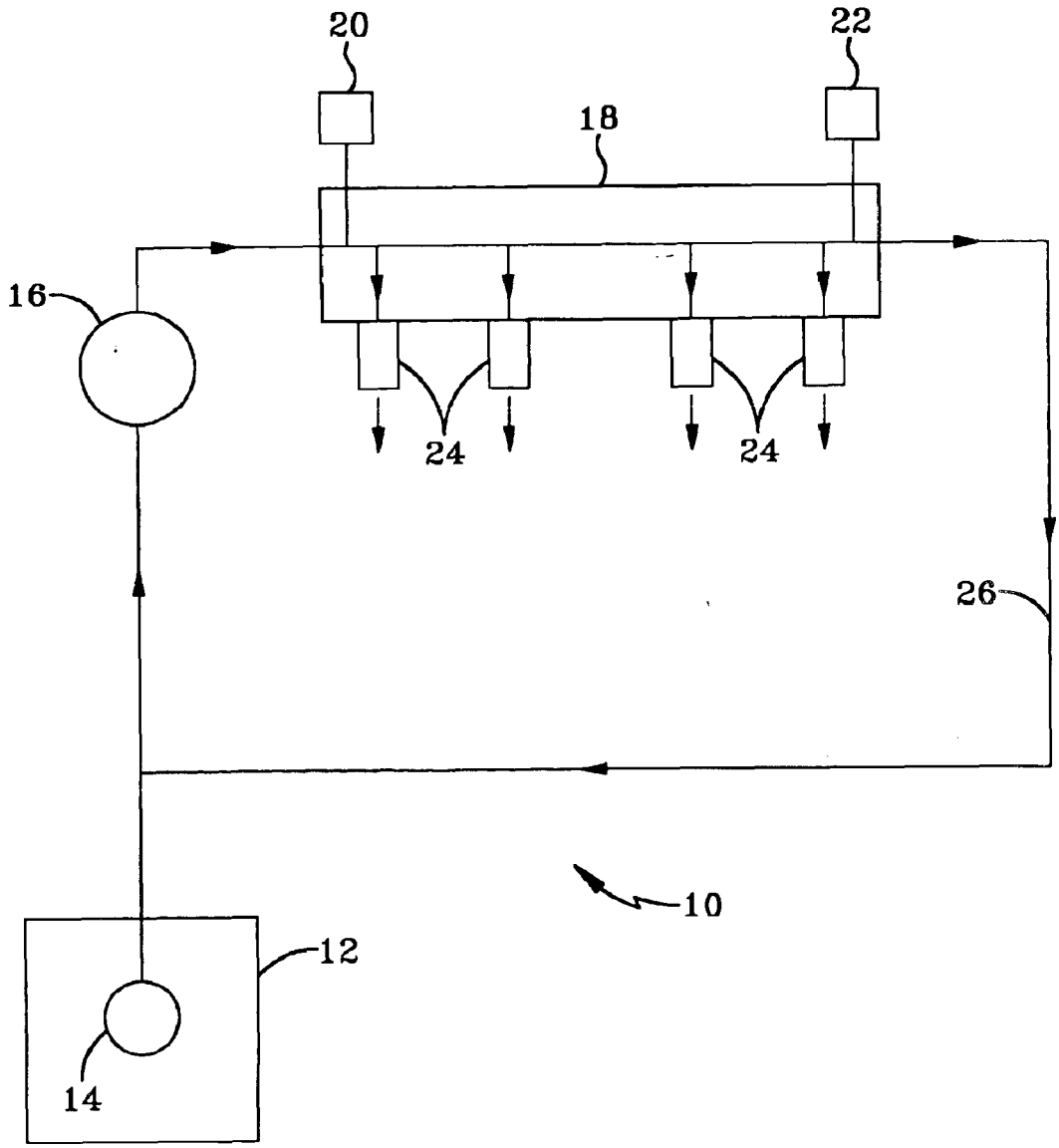
FIG. 1 is a schematic drawing of a high pressure direct injection fuel system.

FIG. 1 is a schematic drawing of a high pressure direct injection fuel system 10. Fuel from a fuel tank 12 is pumped by a low pressure pump 14 to a HP pump 16. The HP pump 16 delivers the fuel to a fuel rail 18. A pressure sensor 20 and high pressure regulator 22 are disposed on the fuel rail 18. Fuel injectors 24 are connected to the fuel rail 18. The fuel injectors 24 inject fuel into the cylinders of an internal combustion engine (not shown). Unused fuel is returned to the low pressure side of the BP pump 16 via return line 26.

Figure 2:
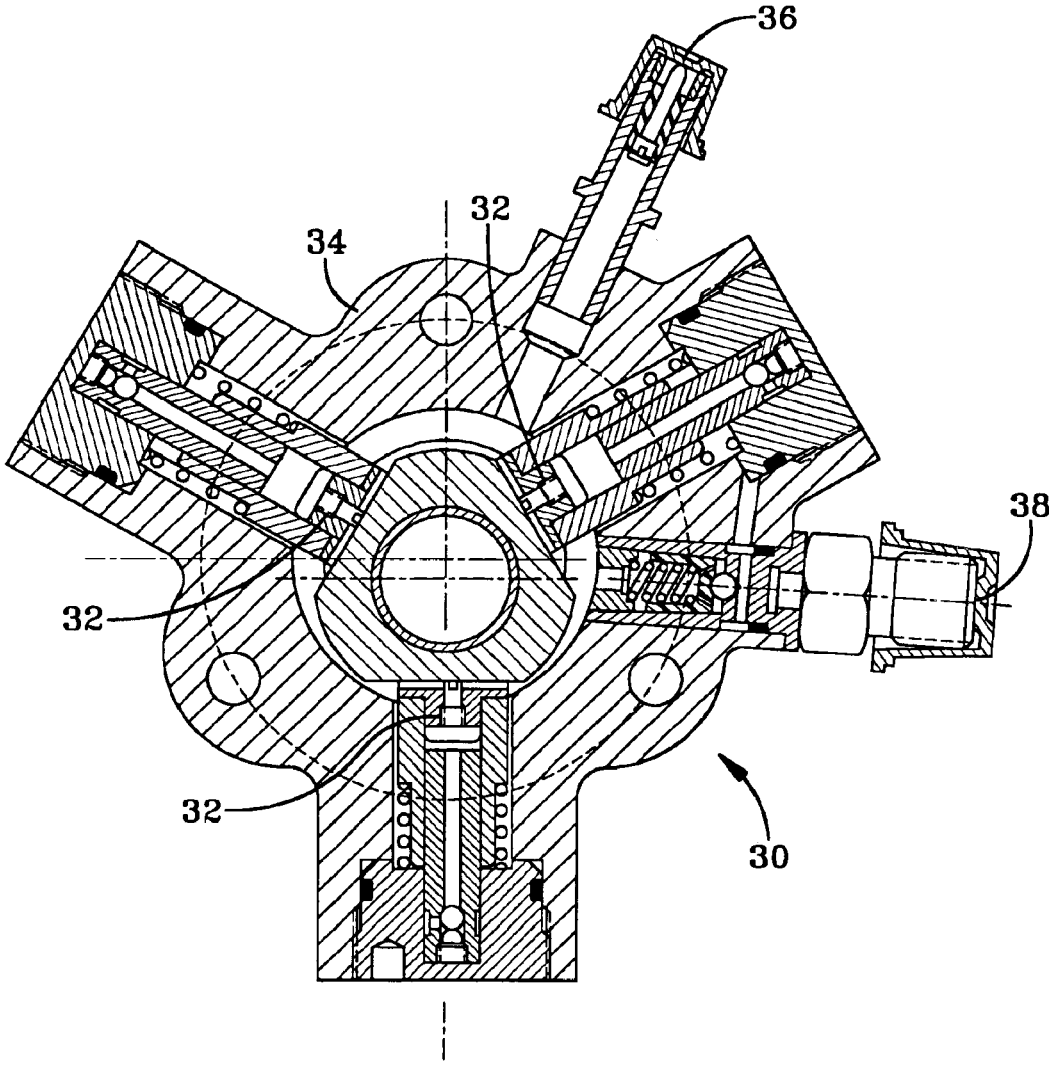
FIG-2 PRIOR ART
FIG. 2 is a cross-section of a known radial type HP pump.

FIG. 2 is a cross-section of a known radial type HP pump 30. The pump 30 includes a housing 34 having a low pressure inlet 36 and a high pressure outlet 38. Three radial type pistons 32 are disposed in the pump 30. The pistons 32 displace low pressure fuel from the inlet 36 to the high pressure outlet 38. The amount of fuel delivered to the fuel rail is dependent only on the engine rpm. Thus, at low engine load conditions, the pump 30 delivers more fuel than is necessary. In addition, even at low engine load conditions, all three pistons 32 are working and consuming engine power.

Figure 3:
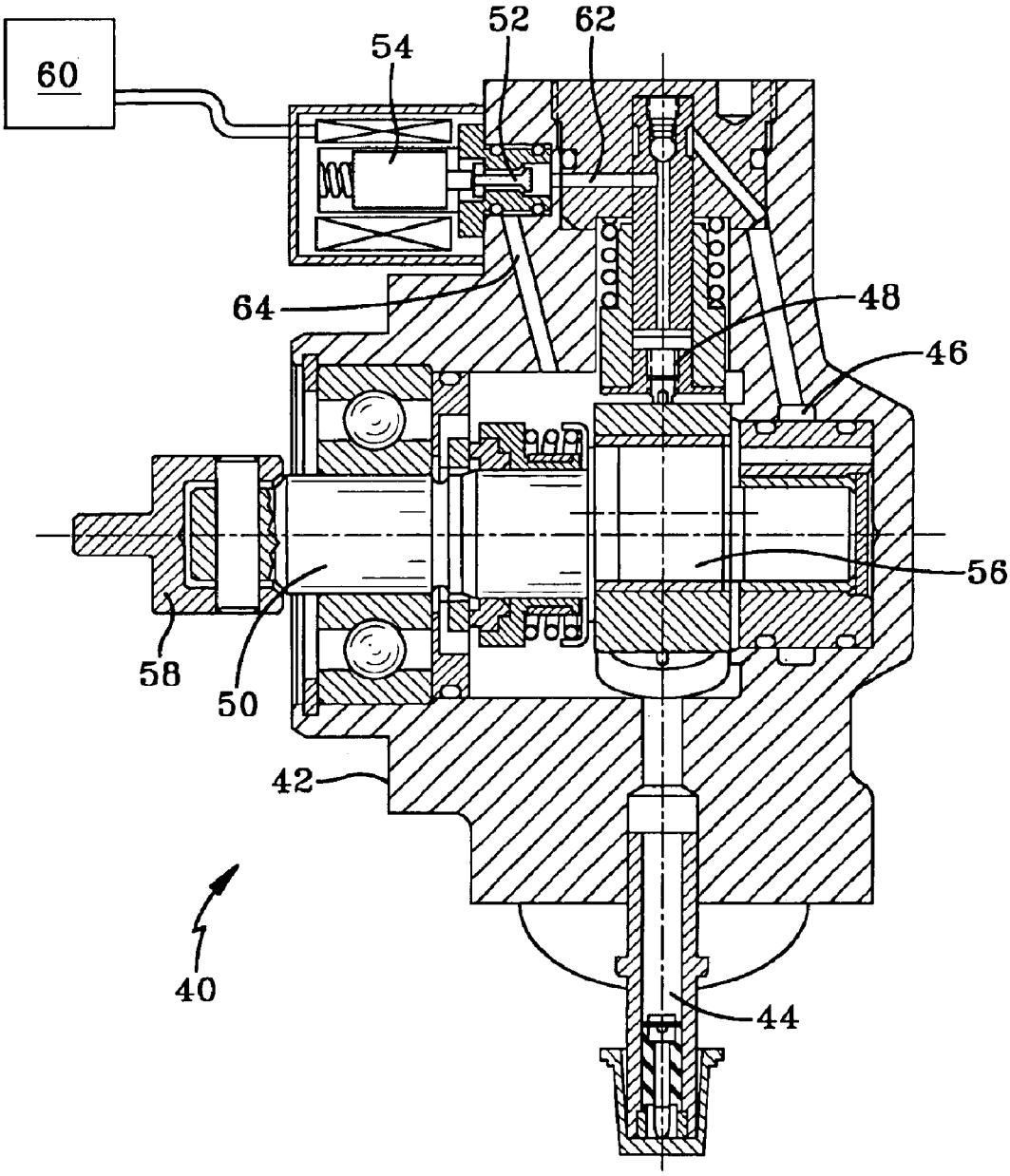
FIG. 3 is a cross-section of an embodiment of a radial piston pump according to the present invention

FIG. 3 is a cross-section of an embodiment of a radial piston pump 40 according to the present invention. The high pressure radial type piston pump 40 includes a housing 42 having a low pressure fuel inlet 44 and a high pressure ring channel 46. The high pressure ring channel 46 collects and connects the pistons 48 high pressure fuel delivery and delivers it to the high pressure outlet (not shown). At least two pistons 48 are disposed in the housing 42. For purposes of clarity, only one piston 48 is shown in FIG. 3. A driveshaft 50 supplies power to drive the pistons 48. The driveshaft 50 receives power from the engine at coupling 58. The driveshaft 50 includes a cam portion 56 for driving the pistons 48.

A bypass valve 52 is fluidly connected to at least one piston 48 to deactivate the piston 48. The bypass valve 52 includes a solenoid 54 for opening and closing the bypass valve 52. FIG. 3 shows the bypass valve 52 open. When the bypass valve is open, fuel displaced by the piston 48 flows to the bypass valve through line 62 and then to the low pressure side of the pump via line 64. Therefore, when the bypass valve 52 is open, the piston 48 is deactivated. When deactivated or disabled, the piston 48 consumes no power except that needed to overcome mechanical friction and flow resistance over the bypass valve 52. Preferably, and as shown in FIG. 3, the bypass valve 52 is normally open such that the piston 48 is normally deactivated. The solenoid 54 is preferably activated by a signal from an engine electronic control unit 60.

In a preferred embodiment, the high pressure piston pump 40 comprises three pistons 48 and the bypass valve 52 is fluidly connected to only one of the three pistons 48. Advantageously, the piston 48 to which the bypass valve 52 is connected has a surface area that is larger than a surface area of each of the other two pistons. Most preferably, the surface area of the piston 48 to which the bypass valve 52 is connected is approximately twice the surface area of each of the other two pistons. By using pistons with different surface areas, the flow output of the pump can be optimized for certain objectives, such as one output for high flow at cold start and one for normal engine running conditions.

Figure 4:
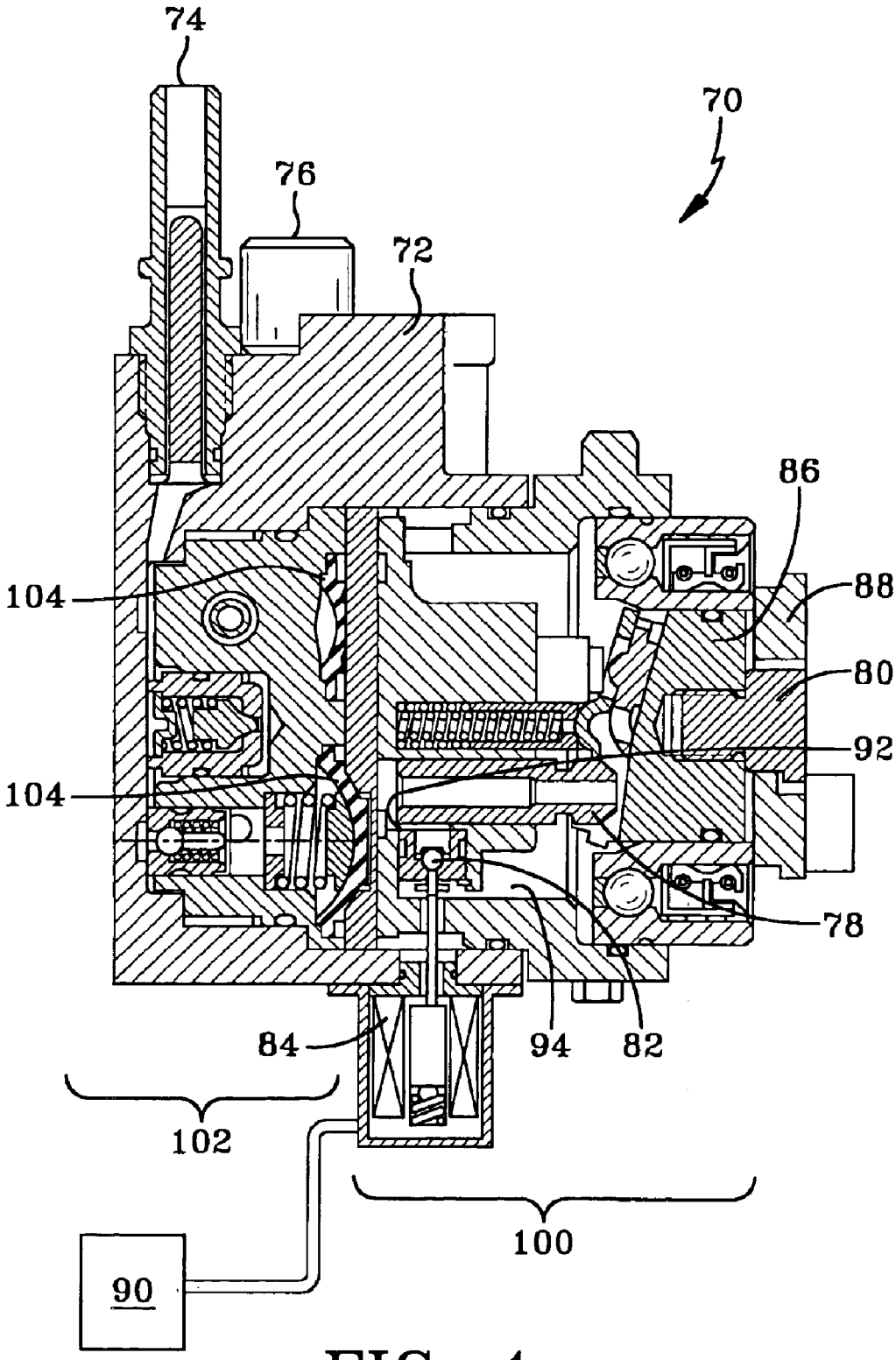
FIG. 4 is a cross-section of an embodiment of an axial piston pump according to the present invention.

FIG. 4 is a cross-section of an embodiment of an axial transfer piston pump 70 according to the present invention. The high pressure axial transfer type piston pump 70 includes a housing 72 having a low pressure fuel inlet 74 and a high pressure fuel outlet 76. At least two pistons 78 are disposed in the housing 72. For purposes of clarity, only one piston 78 is shown in FIG. 4. A driveshaft 80 supplies power to drive the pistons 78. The driveshaft 80 receives power from the engine at coupling 88. The driveshaft 80 includes a swash plate 86 for driving the pistons 78.

The axial type transfer piston pump 70 includes a hydraulic oil side 100 and a fuel side 102. The pistons 78 are disposed in the hydraulic oil side 100. The pump 70 further includes at least two diaphragms 104, one diaphragm for each piston. The diaphragms 104 are disposed in the fuel side 102. Hydraulic oil displaced by each piston 78 acts on a diaphragm 104. The diaphragms 104 then displace fuel disposed in the fuel side 102. The fuel displaced by the diaphragms 104 exits the pump 70 through the high pressure outlet 76.

A bypass valve 82 is fluidly connected to at least one piston 78 to deactivate the piston 78. The bypass valve 82 includes a solenoid 84 for opening and closing the bypass valve 82. FIG. 4 shows the bypass valve 82 closed. When the bypass valve 82 is opened, hydraulic oil displaced by the piston 78 flows to the bypass valve through passage 92 and then to the low (pressure side of the pump via passage 94. Therefore, when the bypass valve 82 is open, the piston 78 is deactivated. When deactivated or disabled, the piston 78 consumes no power except that needed to overcome mechanical friction and flow resistance over the bypass valve 82. Preferably, the bypass valve 82 is normally open such that the piston 78 is normally deactivated. The solenoid 84 is preferably activated by a signal from an engine electronic control unit 90.

For the axial piston transfer pump 70, the bypass path could alternatively be connected to the fuel side 102. However, it is preferable to place the bypass path in the hydraulic oil side 100 to minimize stress on the diaphragm 104 and to minimize friction losses.

In a preferred embodiment, the high pressure piston pump 70 comprises three pistons 78 and the bypass valve 82 is fluidly connected to only one of the three pistons 78. Advantageously, the piston 78 to which the bypass valve 72 is connected has a surface area that is larger than a surface area of each of the other two pistons. Most preferably, the surface area of the piston 78 to which the bypass valve 82 is connected is approximately twice the surface area of each of the other two pistons. By using pistons with different surface areas, the flow output of the pump can be optimized for certain objectives, such as one output for high flow at cold start and one for normal engine running conditions.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A high pressure piston pump, comprising:

a housing having a low pressure fuel inlet and a high pressure fuel outlet;

at least two pistons disposed in the housing;

a driveshaft for supplying power to drive the at least two pistons; and a bypass valve fluidly connected to one of the at least two pistons to deactivate the one piston, wherein the piston to which the bypass valve is connected to has a surface area that is different than a surface area of the other piston of the at least two pistons, and the at least two pistons include respective surface areas reciprocating on a common plane generally orthogonal to the driveshaft.

2. The high pressure piston pump of claim 1 wherein the bypass valve includes a solenoid for opening and closing the bypass valve.

3. The high pressure piston pump of claim 2 wherein the bypass valve is normally open such that the at least one piston is normally deactivated.

4. A high pressure piston pump, comprising:

a housing having a low pressure fuel inlet and a high pressure fuel outlet;

three pistons disposed in the housing;

a driveshaft for supplying power to drive the three pistons; and a bypass valve fluidly connected to at least one of the three pistons to deactivate the at least one piston, wherein the bypass valve is fluidly connected to only one of the three pistons, and wherein the piston to which the bypass valve is connected to has a surface area that is different than a surface area of the other pistons.

5. A high pressure piston pump, comprising:

a housing having a low pressure fuel inlet and a high pressure fuel outlet;

at least two pistons disposed in the housing;

a driveshaft that drives the at least two pistons; and a bypass valve fluidly connected to one of the at least two pistons to deactivate the one piston, wherein the piston to which the bypass valve is connected to has a surface area that is larger than a surface area of the other piston of the at least two pistons, and the at least two pistons comprise respective surface areas reciprocating on a common plane generally orthogonal to the driveshaft.

6. The high pressure piston pump of claim 5 wherein a surface area of the piston to which the bypass valve is connected is approximately twice the surface area of each of the other two pistons.

7. The high pressure piston pump of claim 2 wherein the solenoid is activated by a signal from an engine electronic control unit.

8. The high pressure piston pump of claim 1 wherein the high pressure piston pump is a radial type piston pump.

9. The high pressure piston pump of claim 8 wherein the driveshaft includes a cam portion for driving the at least two pistons.

10. A high pressure radial type piston pump, comprising:

a housing having a low pressure fuel inlet and a high pressure fuel outlet;

three pistons disposed in the housing;

a driveshaft for supplying power to drive the three pistons; and a bypass valve fluidly connected to one of the three pistons to deactivate the one piston, wherein the piston to which the bypass valve is connected to has a surface area that is different than a surface area of each of the other pistons.

11. The high pressure radial type piston pump of claim 10 wherein the bypass valve includes a solenoid for opening and closing the bypass valve.

12. A high pressure radial type piston pump, comprising:

a housing having a low pressure fuel inlet and a high pressure fuel outlet;

three pistons disposed in the housing;

a driveshaft that drives the three pistons; and a bypass valve fluidly connected to one of the three pistons to deactivate the one piston, wherein the bypass valve is normally open, the bypass valve permitting fluid to flow through the bypass valve when the valve is not actuated such that the one piston is normally deactivated.

13. The high pressure radial type piston pump of claim 10, wherein the one piston to which the bypass valve is connected has a surface area that is larger than a surface area of each of the other two pistons.

14. The high pressure radial type piston pump of claim 13, wherein a surface area of the one piston to which the bypass valve is connected is approximately twice the surface area of each of the other two pistons.

15. The high pressure radial type piston pump of claim 11 wherein the solenoid is activated by a signal from an engine electronic control unit.

16. The high pressure piston pump of claim 10 wherein the driveshaft includes a cam portion for driving the three pistons.

17. A method of varying the flow output of a high pressure piston pump having at least two pistons comprising:

pumping fluid by a first piston of the at least two pistons, the first piston having a first surface area;

pumping fluid by a second piston of the at least two pistons, the second piston having a second surface area different from the first surface area; and deactivating one of the at least two pistons wherein the one piston is deactivated by directing fluid displaced by the one piston to a normally open bypass valve that permits fluid to flow through the valve when the valve is not actuated.

18. The method of claim 17 wherein the bypass valve directs the fluid to a low pressure area of the pump.

19. The method of claim 17 wherein the fluid displaced by the at least one piston is fuel for the engine.

20. The method of claim 19 wherein the fluid displaced by the at least one piston is hydraulic oil.

21. The method of claim 17 further comprising closing the bypass valve to reactivate the at least one deactivated piston.

22. A high pressure fuel injection system, comprising:

a source of fuel;

a low pressure pump;

a high pressure piston pump, the low pressure pump being disposed between the fuel source and the high pressure piston pump;

a fuel rail including a plurality of fuel injectors, the high pressure piston pump being disposed between the low pressure pump and the fuel rail; and a fuel return line connecting the fuel rail to a low pressure side of the high pressure pump;

wherein the high pressure piston pump comprises a housing having a low pressure fuel inlet connected to an output of the low pressure pump, a high pressure fuel outlet connected to an input of the fuel rail, at least two pistons disposed in the housing, and a bypass valve fluidly connected to one of the at least two pistons to deactivate the one piston, and wherein the one piston to which the bypass valve is connected to has a surface area that is different than a surface area of the other piston of the at least two pistons.

23. The high pressure fuel injection system of claim 22 further comprising a pressure sensor connected to the fuel rail.

24. The high pressure fuel injection system of claim 23 further comprising a pressure regulator connected to the fuel rail.

25. The high pressure fuel injection system of claim 22 wherein the high pressure piston pump is a radial type piston pump.

26. The high pressure fuel injection system according to claim 22, wherein the bypass valve includes a normally open valve that permits fluid to flow through the valve when the valve is not actuated.

27. The high pressure fuel injection system according to claim 26, wherein the bypass valve includes a solenoid adapted to open and close the bypass valve.

28. A high pressure fuel injection system, comprising:

a source of fuel;

a low pressure pump;

a high pressure piston pump, the low pressure pump being disposed between the fuel source and the high pressure piston pump;

a fuel rail including a plurality of fuel injectors, the high pressure piston pump being disposed between the low pressure pump and the fuel rail; and a fuel return line connecting the fuel rail to a low pressure side of the high pressure pump;

wherein the high pressure piston pump comprises a housing having a low pressure fuel inlet connected to an output of the low pressure pump, a high pressure fuel outlet connected to an input of the fuel rail, at least two pistons disposed in the housing, and a normally open bypass valve fluidly connected from a discharge passage of one of the at least two pistons to a low pressure side passage of the one piston so as to deactivate the one piston.

29. The high pressure piston pump of claim 5, wherein the bypass valve includes a solenoid for opening and closing the bypass valve.

30. The high pressure piston pump of claim 29, wherein the bypass valve is normally open, the bypass valve permitting fluid to flow through the bypass valve when the valve is not actuated such that the at least one piston is normally deactivated.

31. The high pressure radial type piston pump of claim 12, wherein the bypass valve includes a solenoid for opening and closing the bypass valve.

32. The high pressure radial type piston pump of claim 12, wherein the one piston to which the bypass valve is connected has a surface area that is larger than a surface area of each of the other two pistons.

33. The high pressure radial type piston pump of claim 32, wherein a surface area of the one piston to which the bypass valve is connected to is approximately twice the surface area of each of the other two pistons.

34. The high pressure radial type piston pump of claim 31, wherein the solenoid is activated by a signal from an engine electronic control unit.

35. The high pressure radial type piston pump of claim 12, wherein the driveshaft includes a cam portion that drives the three pistons.

* * * * *